United States Patent [19]

Gross

[11] Patent Number: 4,618,754

[45] Date of Patent: Oct. 21, 1986

[54] MEMBRANE SWITCH WITH PIVOTABLE ROCKER

[76] Inventor: David Gross, 2128 Duxbury Cir., Los Angeles, Calif. 90034

[21] Appl. No.: 745,694

[22] Filed: Jun. 17, 1985

[51] Int. Cl.[4] ..... H01H 13/52

[52] U.S. Cl. ..... 200/159 B; 200/335

[58] Field of Search ..... 200/159 B, 335, 339, 200/340

[56] References Cited

U.S. PATENT DOCUMENTS

| | | | |
|---|---|---|---|
| 2,343,060 | 2/1944 | Horning | 200/5 R |
| 2,351,181 | 6/1944 | Bangasser | 200/340 |
| 2,374,986 | 5/1945 | Fetter . | |
| 2,409,483 | 10/1946 | Gandelot | 200/159 B |
| 3,290,439 | 12/1966 | Willcox | 178/17 R |
| 3,731,030 | 5/1973 | Holzer | 200/159 R |
| 4,118,609 | 10/1978 | Schadow et al. | 200/67 DA |
| 4,119,821 | 10/1978 | Overton | 200/159 R |
| 4,311,884 | 1/1982 | Henley et al. | 200/339 |
| 4,346,272 | 8/1982 | Stoll | 200/83 C |
| 4,349,712 | 9/1982 | Michalski | 200/159 B |
| 4,412,108 | 10/1983 | McCarty | 200/339 |

*Primary Examiner*—Stephen Marcus

*Assistant Examiner*—Renee S. Luebke

*Attorney, Agent, or Firm*—Pretty, Schroeder, Brueggemann & Clark

[57] ABSTRACT

A momentary membrane switch that includes not only a normally open set of electrical contacts but also a normally closed set of electrical contacts. In one embodiment, a downward force applied to the switch pivots an elongated, flat rocker, to close the normally open contacts and simultaneously open the normally closed contacts. Pivoting of the rocker is yieldably resisted by an overlaying resilient membrane, which forceably returns the rocker to its original position when the force is removed. In another embodiment, a downward force applied to the switch lowers the center of a special disk into contact with an underlying circuit board, to close the normally open contacts, and simultaneously deforms the disk's periphery upwardly, to open the normally closed contacts. Internal stress in the deformed disk returns the disk to its original position when the force is removed. The rocker and disk are both retained without any special attachment in a specially-sized aperture formed in a spacer located between the underlying circuit board and overlaying membrane.

22 Claims, 10 Drawing Figures

MEMBRANE SWITCH WITH PIVOTABLE ROCKER

BACKGROUND OF THE INVENTION

This invention relates generally to electrical switches, and, more particularly, to momentary electrical switches of the membrane-type that operate in a normally closed fashion.

Membrane switches have been widely used in recent years for many low-voltage applications. This is due in large part to the switch's simple mechanical construction and its flat front face, which allows convenient placement of descriptive graphics and which seals the switch interior from contamination.

Membrane switches typically include a circuit board having spaced electrical contacts fixed on its upper surface, an overlaying spacer with an aperture aligned with the contacts, and a resilient membrane overlaying the spacer. An electrical contact on the underside of the membrane is normally spaced a predetermined distance above the circuit board contacts, whereby a normally open switch is provided. A downward force applied to the membrane lowers the membrane contact into electrical contact with the spaced circuit board contacts, to short the latter together and thereby close the normally open switch. The circuit board can be either rigid or flexible, depending on the application.

The normally open configuration of the momentary membrane switch described briefly above limits its application. In situations where a normally closed configuration is desired, supplemental electronic circuitry is required.

It should be appreciated from the foregoing that there is a need for an electrical switch having substantially all of the attributes of conventional momentary membrane switches, but operating in a normally closed fashion. The present invention fulfills this need.

SUMMARY OF THE INVENTION

The present invention is embodied in a momentary electrical switch of the membrane-type that operates in a normally closed fashion, without the need for supplementary electronic circuitry. The switch is constructed with very few separate elements, and it has substantially all of the attributes of conventional normally open membrane switches such as a thin construction and suitability for displaying graphics information on its flat top surface.

More particularly, the membrane switch of the invention includes a circuit board having an electrical contact fixed on its upper side, and switch means located immediately above the circuit board and including an electrical contact on its underside, normally positioned to touch or contact the circuit board contact and thereby provide a normally closed switch. The switch means contact is located on a first portion of the switch means, while a second portion of the switch means is normally spaced a predetermined distance above the circuit board. Positioning means, including an overlaying resilient membrane, hold the switch means in its prescribed position.

In one embodiment of the invention, the switch means is a flat, elongated rocker, with the first portion and associated electrical contact located at one end and with the second portion located at the other end, spaced above the circuit board. A downward force applied to the portion of the resilient membrane overlaying the rocker's second portion lifts the rocker's first portion and its underlying contact out of electrical contact with the circuit board contact, against the yielding resistance of the resilient membrane. This opens the normally closed switch. Upon removal of the downward force, the resilient membrane forceably returns the rocker to its normal position, with its contact contacting the circuit board contact.

In the first embodiment, a ridge is preferably located on the rocker's underside, between its first and second ends and in continuous contact with the circuit board. A downward force applied to the second end of the rocker pivots the rocker about the ridge, to lift the rocker contact away from the circuit board contact and thereby open the normally closed switch.

In a second embodiment of the invention, the switch means is substantially in the shape of a disk, with the switch means contact located on the underside of the disk's periphery and with the disk's center portion spaced above the circuit board. A circular ridge depends from the disk's periphery and carries the disk's contact, for normal electrical contact with the circuit board contact. In this embodiment, a downward force applied to the portion of the resilient membrane overlaying the disk's center causes the disk's entire peripheral edge to deform upwardly, away from the circuit board contact. Upon removal of the downward force, the internal stress in the deformed disk returns the disk to its original position, with its contact touching the circuit board contact.

The positioning means of both embodiments of the switch preferably further includes spacer means located between the circuit board and the resilient membrane, surrounding the switch means. The spacer means functions to prevent lateral movement of the switch means relative to the circuit board. In addition, the maximum thickness of the spacer means is preferably slightly less than that of the switch means, such that the overlaying resilient membrane applies a continuous downward force to hold the switch means in its prescribed position. The switch is preferably free of any separate means for attaching the switch means to the spacer means or the circuit board.

In another aspect of the invention, applicable to both embodiments, the membrane switch further includes a normally open set of contacts. In particular, a second contact is fixed on the upperside of the circuit board and an aligned second contact is fixed on the underside of the switch means, in the portion of the switch means normally spaced above the circuit board. A downward force applied to that portion of the switch means moves the respective second contacts into electrical contact with each other. The second circuit board lead can advantageously be fixed on a second circuit board located immediately beneath the first circuit board and accessible through an aperture formed in the first circuit board.

Other aspects and advantages of the present invention will become apparent from the following description of the preferred embodiments, taken in conjunction with the accompanying drawings, which illustrate, by way of example, the principles of the invention.

DESCRIPTION OF THE PREFERRED EMBODIMENTS

Figure 1:
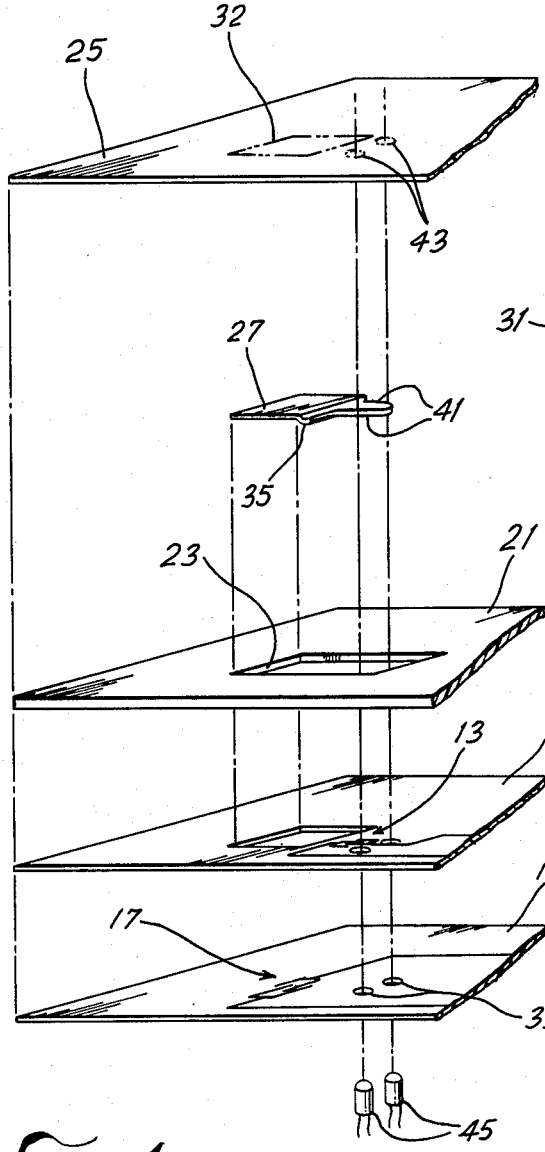
FIG. 1 is an exploded perspective view of one embodiment of a combined normally closed and normally open membrane switch constructed in accordance with the present invention.

As shown in the exemplary drawings, the present invention is embodied in a momentary membrane switch that is arranged in a normally closed configuration, without the need for supplementary electronic circuitry. A first embodiment of the switch, depicted in FIGS. 1–5, includes an upper circuit board 11 having a first set of spaced electrical contacts 13 fixed on its upper surface, and a lower circuit board 15 having a second set of spaced electrical contacts 17 fixed on its upper surface. The upper circuit board is positioned immediately over the lower circuit board, with an aperture 19 in the upper board aligned with the second set of contacts. A thin spacer 21 overlays the upper circuit board and includes an aperture 23 aligned with the two set of contactss 13 and 17. A thin resilient membrane 25 overlays the spacer, including its aperture, to provide the switch with a uniform, flat upper surface.

In accordance with the invention, the switch further includes a thin, elongated rocker 27 located within the aperture 23 of the spacer 21 and sized to be confined in that aperture without any substantial lateral movement. Electrical contacts 29 and 31 (FIG. 3) are located on the bottom side of the rocker, one contact at each end. The first rocker contact 29 is positioned in alignment with the first set of circuit board contacts 13, and the second rocker contact 31 is similarly positioned in alignment with the second set of circuit board contacts 17.

Figure 4:
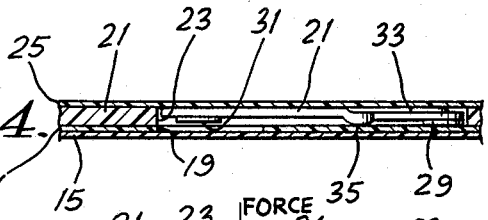
FIG. 4 is a side sectional view of the membrane switch of FIG. 1, shown in its assembled condition.

As shown in FIG. 4, the rocker 27 is configured such that it rests on the upper circuit board 11 with its first contact 29 normally touching and electrically shorting together the first set of spaced circuit board contacts 13 and with its second contact 31 normally located slightly above the second set of circuit board contacts 17. Thus, the first set of contacts provides a normally closed switch configuration while the second set of contacts simultaneously provides a normally open switch configuration.

Figure 5:
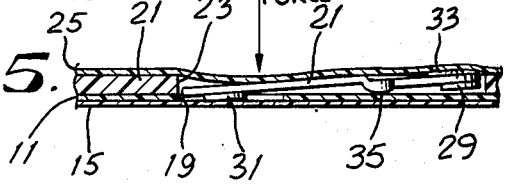
FIG. 5 is a side sectional view similar to FIG. 4, but with a downward force being applied to one end of the elongated rocker, to open the normally closed contacts and simultaneously close the normally open contacts.

FIG. 5 depicts the position of the rocker 27 when a downward force is applied, as for example by a finger, to the portion of the membrane 25 overlaying the end of the rocker that is spaced slightly above the circuit boards 11 and 15. This pivotally lowers that end of the rocker until its second contact 31 projects into the aperture 19 of the upper circuit board 11 to contact the second set of circuit board contacts 17. Simultaneously, the first rocker contact 29 pivotally lifts away from the first set of circuit board contacts 13. Yielding resistance to this pivoting movement is provided by the resilient membrane 25, which stretches upwardly in the region of the rocker's first end. When the downward force is removed, the stretched membrane forceably returns the rocker to its original position (FIG. 4).

Thus, the invention provides a membrane switch having all of the attributes of conventional membrane switches, e.g., a set of normally open contacts, a thin, simple construction, and a flat upper surface suitable for carrying appropriate graphics information, as for example indicated by the reference numeral 32. In addition, however, the invention provides a second set of contacts, this set in a normally closed configuration. This additional feature significantly enhances the switch's utility without introducing any real drawbacks. The normally open and normally closed configurations can be used cooperatively as an electrical and mechanical lockout mechanism.

Figure 2:
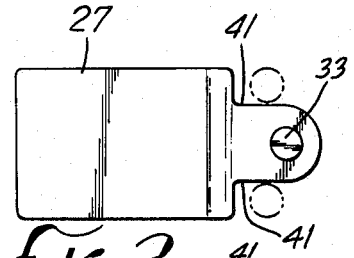
FIG. 2 is a top plan view of the elongated rocker of the membrane switch of FIG. 1.
Figure 3:
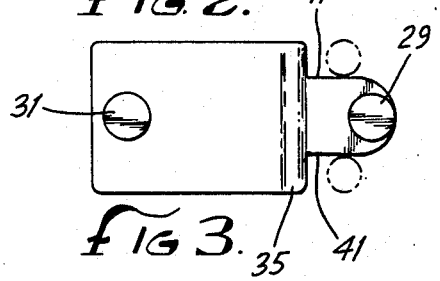
FIG. 3 is a bottom plan view of the elongated rocker of the membrane switch of FIG. 1.

As best shown in FIGS. 1 and 2, the first end of the rocker 27, which is associated with the first set of circuit board contacts 13, includes a pressure pad 33 centrally located on its upper side to provide the rocker with a maximum thickness that is slightly greater than the thickness of the spacer 21. This stretches the membrane slightly upwardly, even when no downward force is being applied to the rocker's second end, to ensure that a continuous downward force is applied to the rocker's first end. This maintains the rocker's first contact 29 in continuous electrical contact with the first set of circuit board contacts 13, thus shorting those latter contacts together.

The two ends of the rocker 27 are separated from each other by a shallow ridge 35 depending from the rocker's bottom surface, substantially perpendicular to the rocker's longitudinal axis. A downward force applied to the rocker's second end causes the rocker to pivot on this ridge, which remains in continuous contact with the upper circuit board 11.

The two circuit boards 11 and 15, the spacer 21 and the resilient membrane 25 can all be formed of any suitable plastic material such as polycarbonate or polyester. The rocker 27 can be formed of either spring stainless steel or rigid polycarbonate or polyester. The sets of contacts 13 and 17 fixed on the two circuit boards, as well as the contacts 29 and 31 fixed on the underside of the rocker, are preferably silver and coated on their respective surfaces using conventional circuit board techniques. In assembling the various elements of the switch, the circuit boards 11 and 15, spacer 21, and resilient membrane 25 are cemented together in their appropriate positions, with the rocker 27 simply being positioned in the spacer's aperture 23 without any positive attachment means. The aperture and rocker are sized relative to each other such that only the prescribed pivoting movemen is permitted. This greatly simplifies construction of the switch and enhances its reliability.

The pressure pad 33 located on the upper surface of the first end of the rocker 27 is preferably spaced from the rocker's peripheral edge. This position is, in turn, spaced a corresponding amount from the surface interface of the spacer 21 and overlaying resilient membrane 27. This spacing reduces the possibility that stretching of the membrane will break the surface bond between the membrane and the underlying spacer.

In some switch applications, it is desirable to utilize one or more light sources as status indicators and thus provide feedback to the switch operator. To this end, apertures 37 and 39 are formed in the respective circuit boards 11 and 15, adjacent to the first set of contacts 15, and corresponding cutouts 41 are formed in the overlaying rocker 27. The corresponding portions of the overlaying resilient membrane 25 are made transparent or translucent, as indicated by the reference numeral 43. Thus, light emitted by light bulbs 45 located beneath the switch is visible from above the switch. Suitable electronic circuitry (not shown) can be used to switch the two bulbs on and off and thereby indicate the switch's status.

FIGS. 6–10 depict a second embodiment of a momentary membrane switch constructed in accordance with the present invention. Elements of this switch embodiment that have corresponding elements in the embodiment of FIGS. 1–5 are identified by the same reference numerals, but with associated primes.

Figure 6:
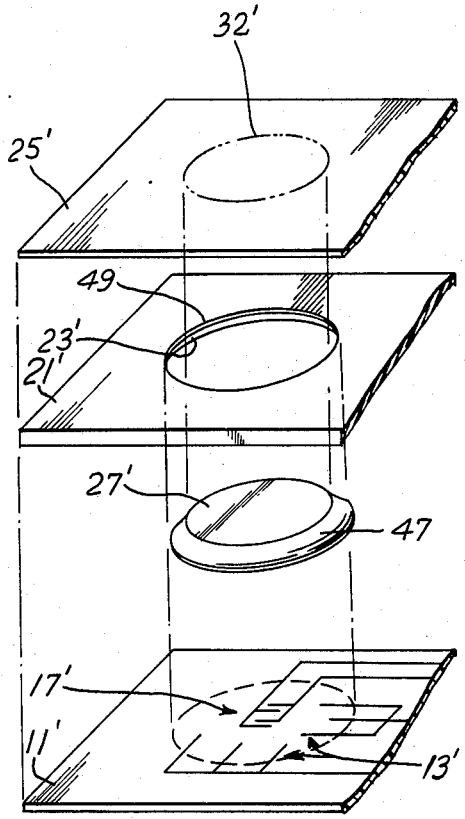
FIG. 6 is an exploded perspective view of an alternative embodiment of a combined normally closed and normally open membrane switch constructed in accordance with the present invention.

The individual switch elements of the switch embodiment of FIGS. 6–10 are similar to those of FIGS. 1–5, with the elongated rocker 27 of the first embodiment being replaced by a disk-shaped switch element 27'. The first and second sets of spaced circuit board contacts 13' and 17' are located on the same circuit board 11', as depicted in FIG. 6. The aperture 23' formed in the spacer 21' is substantially circular and sized to receive the switch element without permitting any significant lateral movement of the element relative to the circuit board.

Figure 7:
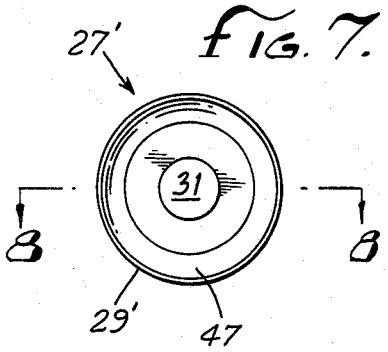
FIG. 7 is a bottom plan view of the disk-shaped switch element of the membrane switch of FIG. 6.
Figure 8:
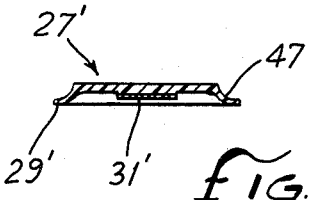
FIG. 8 is a side sectional view of the disk-shaped switch element of FIG. 6, taken substantially in the direction of the arrows 8—8 in FIG. 7.

As best shown in FIGS. 7–8, the first switch contact 29' is located on a circular ridge 47 projecting downwardly and outwardly from the periphery of the disk-shaped switch element 27', while the second switch contact 31' is located on a shallow projection in the center of the element's underside. When the switch is assembled, the first switch contact is aligned with the first set of circuit board contacts 13' and the second switch contact is aligned with the second set of circuit board contacts 17'.

Figure 9:
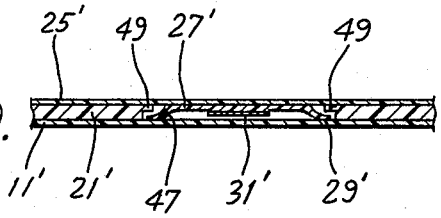
FIG. 9 is a side sectional view of the membrane switch of FIG. 6, shown in its assembled condition.

FIG. 9 depicts the second switch embodiment in its assembled condition. The first switch contact 29' touches and shorts together the first set of circuit board contacts 13', while the second switch contact 31' is spaced slightly above the second set of circuit board contacts 17'. The thickness of the switch element 27' is preferably sized to be slightly thicker than the thickness of spacer 21', to ensure that the overlaying resilient membrane 25' applies a continuous downward force to the switch element, to maintain the electrical connection between the first switch contact 29' and the first set of circuit board contacts 13'.

Figure 10:
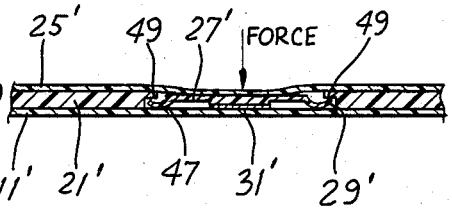
FIG. 10 is a side sectional view similar to FIG. 9, but with a downward force being applied to the center of the disk-shaped switch element, to open the normally closed contacts and simultaneously close the normally open contacts.

FIG. 10 depicts the second switch embodiment when a downward force is applied, as for example by a finger, to the portion of the membrane 25' overlaying the center of the disk-shaped switch element 27'. This downward force lowers the center of the element's underside into contact with the circuit board 11', whereby the second switch contact 31' shorts together the second set of spaced circuit board contacts 17'. Simultaneously, the circular ridge 47 on the element's underside deforms upwardly, away from the circuit board, whereby the first switch contact 29' is moved away from the first set of spaced circuit board contacts 13'. The ridge deformation results from the upward, reactive force applied to the element by the circuit board. Upon removal of the downward force, the internal stress in the deformed switch element returns it to its original position (FIG. 9).

The spacer 21' includes an inwardly projecting lip 49 that functions both to inhibit lateral movement of the disk-shaped switch element 27' and to isolate the periphery of the element 27' from any downward force. Without such isolation, a downward force applied off-center might cause both sets of contacts 13' and 17' to be shorted together.

It will be appreciated that the switch embodiment of FIGS. 6–10 could be modified to include a lower circuit board, with the second set of contacts carried on that lower board and accessible through an aperture in the upper board. Such an alternative embodiment would be analogous in this respect to the embodiment of FIGS. 1–5. Conversely, it will be appreciated that the switch embodiment of FIGS. 1–5 could be modified such that both of the circuit board contacts 13 and 17 are located on the same aperture.

It should be appreciated from the foregoing description that the present invention provides an improved membrane switch that includes not only the customary normally open switch configuration but also a normally closed switch configuration. In one embodiment, a downward force applied to the switch pivots a special rocker, to close one set of contacts and open another. This pivoting is yieldably resisted by a overlaying resilient membrane, which forceably returns the rocker to its original position when the downward force is removed. In another embodiment, a downward force applied to the switch lowers the center portion of a special disk into contact with an underlying circuit board while the disk's periphery deforms upwardly and out of contact with the circuit board. Internal stress in the deformed disk returns the disk to its original position when the force is removed.

Although the invention has been described in detail with reference to the presently preferred embodiments, it will be appreciated that those of ordinary skill in the art can make various modifications to the embodiments without departing from the invention. Accordingly, the invention is defined only by the following claims.

I claim:

1. A normally closed membrane switch comprising:

a circuit board having an electrical contact fixed thereon;

rocker means located immediately above the circuit board and including a first end and a second end, the first end having an electrical contact on its underside, normally positioned to electrically contact the circuit board contact, and the second end being normally spaced a predetermined distance above the circuit board; and positioning means for holding the rocker means in its prescribed position above the circuit board, the positioning means including a resilient membrane overlaying the rocker means;

wherein a downward force applied to the portion of the resilient membrane overlaying the second end of the rocker means pivotally lifts the rocker means contact out of electrical contact with the circuit board contact, against the yielding resistance of the resilient membrane, and wherein, upon removal of the downward force, the resilient membrane forceably returns the rocker means to its normal position, with the rocker means contact again electrically contacting the circuit board contact.

2. A normally closed membrane switch as defined in claim 1, wherein:

the rocker means includes a ridge on its underside, between its first and second ends, the ridge being in continuous contact with the circuit board; and a downward force applied to the second end of the rocker means pivots the rocker means about the ridge, to lift the rocker means contact out of electrical contact with the circuit board contact.

3. A normally closed membrane switch as defined in claim 1, wherein:

the rocker means is substantially planar; and the second end of the rocker means has a uniform thickness less than that of the first end of the rocker means.

4. A normally closed membrane switch as defined in claim 1, wherein:

the circuit board includes a light transmissive portion;

the rocker means includes a cutaway portion overlaying the light transmissive portion of the circuit board; and the resilient membrane includes a light transmissive portion overlaying the cutaway portion of the rocker means;

whereby light emitted by a light source located beneath the circuit board, aligned with the light transmissive portion of the circuit board, is visible from a location above the switch.

5. A normally closed membrane switch as defined in claim 1, wherein:

the circuit board further includes a second electrical contact, spaced from the first electrical contact;

the rocker means contact is normally positioned to electrically contact both the first and the second circuit board contacts and thereby electrically short the circuit board contacts together; and a downward force applied to the portion of the resilient membrane overlaying the second end of the rocker means pivots the rocker means contact out of electrical contact with the circuit board contacts, to break the electrical connection between them.

6. A normally closed membrane switch as defined in claim 1, wherein:

the circuit board further includes a second circuit board contact fixed thereon, beneath the second end of the rocker means;

the second end of the rocker means includes a second electrical contact on its underside, normally spaced the predetermined distance above the second circuit board contact; and a downward force applied to the portion of the resilient membrane overlaying the second end of the rocker means pivotally lowers the second rocker means contact into electrical contact with the second circuit board contact.

7. A normally closed membrane switch as defined in claim 6, wherein the circuit board is substantially planar and includes a shallow recess beneath the second end of the rocker means, the second circuit board contact being located within the recess.

8. A normally closed membrane switch as defined in claim 7, wherein the circuit board includes:

an upper board carrying the first circuit board contact and including an aperture; and a lower board located immediately beneath the upper board and carrying the second circuit board contact, accessible from above through the aperture of the upper board.

9. A normally closed membrane switch as defined in claim 1, wherein the positioning means further includes spacer means located between the circuit board and the resilient membrane and having a thickness approximately the same as the maximum thickness of the rocker means, the spacer means preventing lateral movement of the rocker means relative to the circuit board.

10. A normally closed membrane switch as defined in claim 9, wherein:

the rocker means is substantially planar;

the spacer means encircles and abuts the rocker means; and the switch is free of any means for attaching the rocker means to the positioning means or the circuit board.

11. A normally closed membrane switch as defined in claim 10, wherein:

the spacer means has a substantially uniform thickness; and the first end of the rocker means has a maximum thickness slightly greater than that of the spacer means, such that, in the absence of any externally applied force, the resilient membrane applies a continuous downward force to the first end, to maintain the rocker means contact in electrical contact with the circuit board contact.

12. A normally closed membrane switch as defined in claim 11, wherein:

the positioning means further includes bonding means for bonding the resilient membrane to the upper surface of the spacer means; and the maximum thickness of the first end of the rocker means occurs at a location spaced from the spacer means, to reduce the possibility of a failure of the bonding means.

13. A normally closed membrane switch comprising:

a circuit board having first and second electrical contacts in spaced relationship to each other;

thin, substantially planar rocker means located immediately above the circuit board and including a first end and a second end, the first end having an electrical contact on its underside, normally positioned to electrically contact and short together the first and second circuit board contacts, and the second end sized such that it is normally spaced a predetermined distance above the circuit board; and positioning means for holding the rocker means in its prescribed position above the circuit board, the positioning means including spacer means encircling and abutting the rocker means, to prevent the rocker means from moving laterally relative to the circuit board, and a resilient membrane overlaying the spacer means and the rocker means;

wherein the switch is free of any means for attaching the rocker means to the positioning means;

and wherein a downward force applied to the portion of the resilient membrane overlaying the second end of the rocker means pivotally lifts the rocker means contact out of electrical contact with the first and second circuit board contacts, against the yielding resistance of the resilient membrane, and wherein, upon removal of the downward force, the resilient membrane forcibly returns the rocker means to its normal position, with the rocker means contact again electrically contacting and shorting together the first and second circuit board contacts.

14. A normally closed membrane switch as defined in claim 13, wherein:

the spacer means has a substantially uniform thickness;

the first end of the rocker means has a maximum thicknesa slightly greater than that of the spacer means, such that, in the absence of any externally applied force, the resilient membrane applies a continuous downward force to the first end, to maintain the rocker means contact in electrical contact with the first and second circuit board contacts;

the positioning means further includes bonding means for bonding the resilient membrane to the upper surface of the spacer means; and the maximum thickness of the first end of the rocker means occurs at a location spaced from the spacer means, to reduce the possibility of a failure of the bonding means.

15. A normally closed membrane switch as defined in claim 13, wherein:

the rocker means includes a ridge on its underside, between its first and second ends, the ridge being in continuous contact with the circuit board; and a downward force applied to the second end of the rocker means pivots the rocker means about the ridge, to lift the rocker means contact out of electrical contact with the first and second circuit board contacts.

16. A normally closed membrane switch as defined in claim 13, wherein:

the circuit board further includes third and fourth electrical contacts fixed thereon, in spaced relationship to each other beneath the second end of the rocker means;

the second end of the rocker means includes a second electrical contact on its underside, normally spaced the predetermined distance above the third and fourth circuit board contacts; and a downward force applied to the portion of the resilient membrane overlaying the second end of the rocker means pivotally lowers the second rocker means contact into electrical contact with the third and fourth circuit board contacts, to short together the third and fourth contacts.

17. A normally closed membrane switch as defined in claim 13, wherein:

the circuit board includes a light transmissive portion;

the rocker means includes a cutaway portion overlaying the light transmissive portion of the circuit board; and the resilient membrane includes a light transmissive portion overlaying the cutaway portion of the rocker means;

whereby light emitted by a light source located beneath the circuit board, aligned with the light transmissive portion of the circuit board, is visible from a location above the switch.

18. A membrane switch comprising:

a circuit board having an electrical contact fixed thereon;

rocker means located immediately above the circuit board and including a first end and a second end, the first end normally positioned to contact the circuit board and the second end normally spaced a predetermined distance above the circuit board, the rocker means further including an electrical contact on its underside; and positioning means for holding the rocker means in its prescribed position above the circuit board, the positioning means including a resilient membrane overlaying the rocker means;

wherein a downward force applied to the portion of the resilient membrane overlaying the second end of the rocker means pivotally lifts the first end of the rocker means out of contact with the circuit board, against the yielding resistance of the resilient membrane, and wherein, upon removal of the downward force, the resilient membrane forcibly returns the rocker means to its normal position, with the first end of the rocker means again contacting the circuit board;

and wherein the pivotal lifting and return of the rocker means moves the rocker means contact into and out of electrical contact with the circuit board contact.

19. A membrane switch as defined in claim 18, wherein:

the rocker means contact is located on the underside of the rocker means' first end, normally positioned in electrical contact with the circuit board contact; and a downward force applied to the portion of the resilient membrane overlaying the second end of the rocker means pivotally lifts the rocker means contact out of electrical contact with the circuit board contact, such that a normally-closed switch function is provided.

20. A membrane switch as defined in claim 18, wherein:

the rocker means contact is located on the underside of the rocker means' second end, normally positioned out of electrical contact with the circuit board contact; and a downward force applied to the portion of the resilient membrane overlaying the second end of the rocker means pivotally lowers the rocker means contact into electrical contact with the circuit board contact, such that a normally-open switch function is provided.

21. A membrane switch as defined in claim 18, wherein:

the positioning means further includes spacer means located between the circuit board and the resilient membrane and having a thickness approximately the same as the maximum thickness of the rocker means, the spacer means preventing lateral movement of the rocker means relative to the circuit board;

the rocker means is substantially planar;

the spacer means encircles and abuts the rocker means; and the switch is free of any means for attaching the rocker means to the holding means or the circuit board.

22. A membrane switch as defined in claim 21, wherein:

the spacer means has a substantially uniform thickness;

the first end of the rocker means has a maximum thickness slightly greater than that of the spacer means, such that, in the absence of any externally applied force, the resilient membrane applies a continuous downward force to the first end, to maintain the first end of the rocker means in contact with the circuit board;

the positioning means further includes bonding means for bonding the resilient membrane to the upper surface of the spacer means; and the maximum thickness of the first end of the rocker means occurs at a location spaced from the spacer means, to reduce the possibility of a failure of the bonding means.

* * * * *